US010883675B1

(12) United States Patent
Hsu

(10) Patent No.: US 10,883,675 B1
(45) Date of Patent: Jan. 5, 2021

(54) FLASHLIGHT AND ACOUSTICS ASSEMBLY WITH GROOVED CONNECTING UNIT AND EMBEDDED MAGNET

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/658,341

(22) Filed: Oct. 21, 2019

(51) Int. Cl.

| | |
|---|---|
| ***F21L 4/08*** | (2006.01) |
| ***F21V 33/00*** | (2006.01) |
| ***F21V 21/088*** | (2006.01) |
| ***G08B 5/38*** | (2006.01) |
| ***F21V 17/10*** | (2006.01) |
| ***F21V 17/16*** | (2006.01) |
| *F21W 111/10* | (2006.01) |

(52) U.S. Cl.
CPC ..... *F21L 4/085* (2013.01); *F21V 17/104* (2013.01); *F21V 17/105* (2013.01); *F21V 17/16* (2013.01); *F21V 21/0885* (2013.01); *F21V 33/0052* (2013.01); *G08B 5/38* (2013.01); *F21W 2111/10* (2013.01)

(58) Field of Classification Search
None
See application file for complete search history.

(56) References Cited

U.S. PATENT DOCUMENTS

2015/0036330 A1* 2/2015 Economos ..... F21L 4/08 362/183
2019/0137034 A1* 5/2019 Fan ..... F16M 11/041

* cited by examiner

*Primary Examiner* — Evan P Dzierzynski
*Assistant Examiner* — Keith G. Delahoussaye
(74) *Attorney, Agent, or Firm* — Alan D. Kamrath; Karin L. Williams; Mayer & Williams PC

(57) ABSTRACT

A flashlight and acoustics assembly includes a mounting seat, an outer shell mounted on the mounting seat, a housing mounted in the outer shell, a lighting unit mounted on an outside of the housing, a rechargeable battery mounted in the housing, a sound device mounted in the housing, a magnet mounted in the housing, and a connecting unit mounted in the housing. The lighting unit and the sound device are electrically connected with the rechargeable battery. The connecting unit includes a connecting board locked on the housing, and a connecting rod connected with the connecting board. Thus, the housing is mounted in the outer shell steadily by magnetism of the magnet.

9 Claims, 4 Drawing Sheets

FLASHLIGHT AND ACOUSTICS ASSEMBLY WITH GROOVED CONNECTING UNIT AND EMBEDDED MAGNET

BACKGROUND OF THE INVENTION

1. Field of the Invention

The present invention relates to a lighting apparatus and, more particularly, to a flashlight and acoustics assembly.

2. Description of the Related Art

A conventional flashlight comprises a handheld shell, a battery, an electric bulb, and a focused reflective lens. Thus, the conventional flashlight provides a lighting function. In addition, the conventional flashlight is combined with an acoustics to provide an audio function. However, the conventional flashlight cannot be positioned at a determined place and has to be held by a user's one hand, such that the user has to do his/her work by the other hand, thereby greatly causing inconvenience to the user when doing a work that needs cooperation of two hands.

BRIEF SUMMARY OF THE INVENTION

The primary objective of the present invention is to provide a flashlight and acoustics assembly that is mounted easily.

In accordance with the present invention, there is provided a flashlight and acoustics assembly comprising a housing, a lighting unit mounted on an outside of the housing, a rechargeable battery mounted in the housing, a sound device mounted in the housing, a magnet mounted in the housing, and a connecting unit mounted in the housing. The lighting unit is electrically connected with the rechargeable battery. The sound device is electrically connected with the rechargeable battery. The connecting unit includes a connecting board locked on a bottom of the housing, and a connecting rod connected with the connecting board. The connecting board is provided with a mounting hole. The connecting rod is mounted in the mounting hole of the connecting board. The magnet is locked between the connecting board and the connecting rod.

According to the primary advantage of the present invention, the housing is mounted in the outer shell steadily by magnetism of the magnet, such that it is unnecessary for the user to hold the flashlight and acoustics assembly constantly by one hand, thereby greatly facilitating the user doing a work by two hands.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
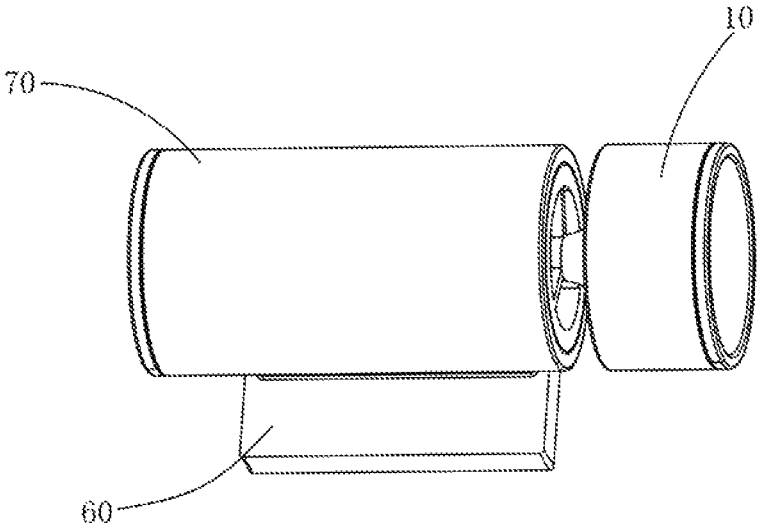
FIG. 1 is a perspective view of a flashlight and acoustics assembly in accordance with the preferred embodiment of the present invention.
Figure 2:
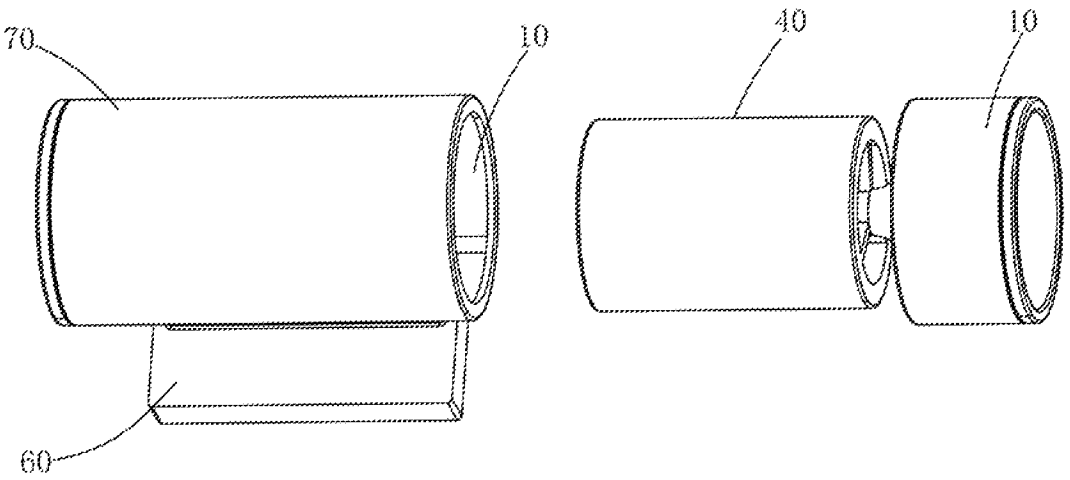
FIG. 2 is a partial exploded perspective view of the flashlight and acoustics assembly in accordance with the preferred embodiment of the present invention.
Figure 3:
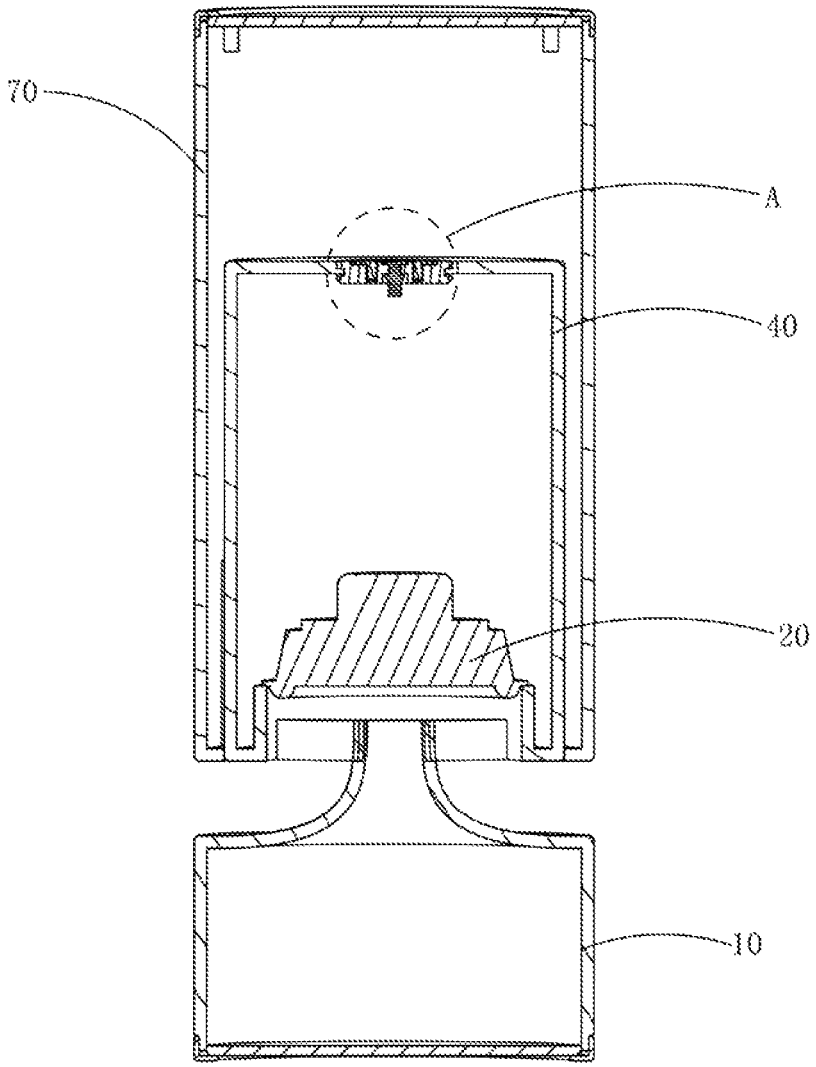
FIG. 3 is a cross-sectional view of the flashlight and acoustics assembly in accordance with the preferred embodiment of the present invention.
Figure 4:
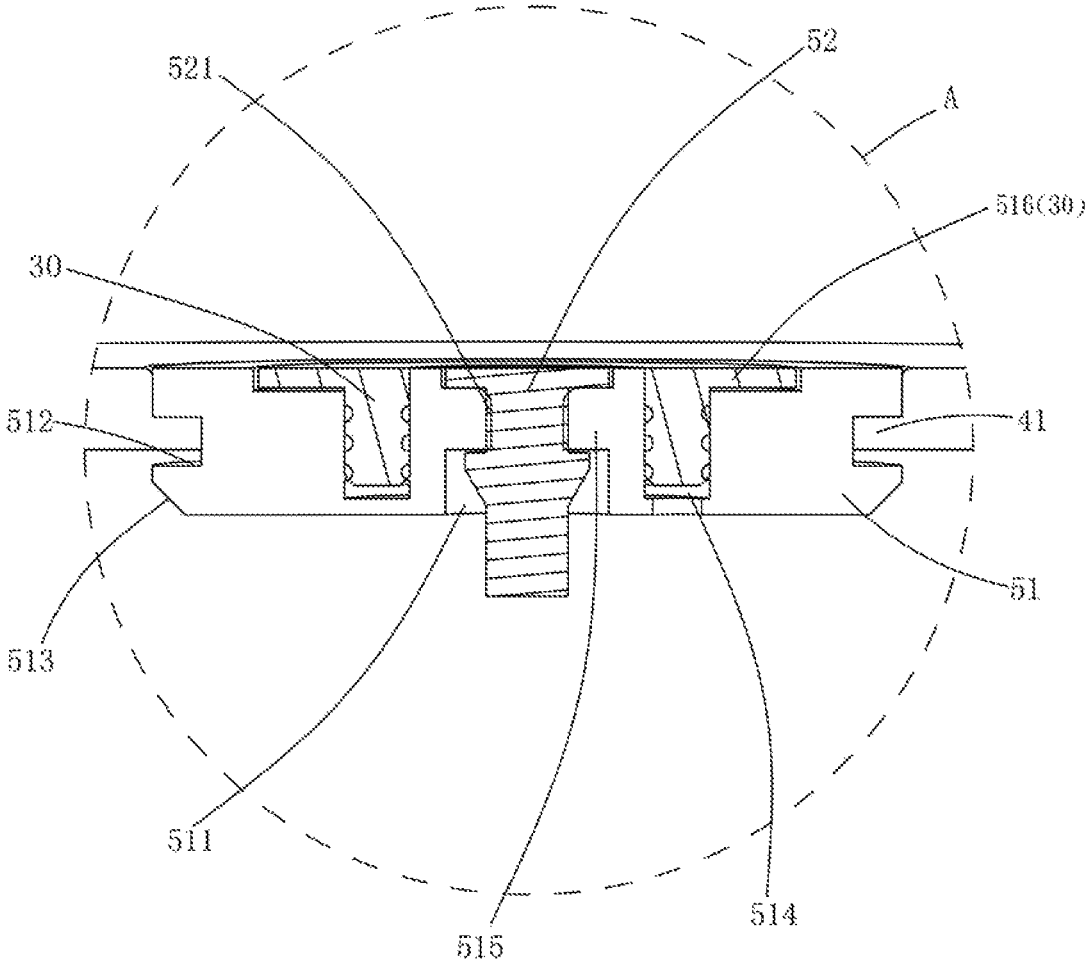
FIG. 4 is a locally enlarged view of the flashlight and acoustics assembly taken along a marking "A" as shown in FIG. 3.

Referring to FIGS. 1-4, a flashlight and acoustics assembly in accordance with the preferred embodiment of the present invention comprises a housing 40, a lighting unit 10 mounted on an outside of the housing 40, a rechargeable battery mounted in the housing 40, a sound device 20 mounted in the housing 40, a magnet 30 mounted in the housing 40, and a connecting unit mounted in the housing 40.

The lighting unit 10 is electrically connected with the rechargeable battery. The sound device 20 is electrically connected with the rechargeable battery. The connecting unit includes a connecting board 51 locked on a bottom of the housing 40, and a connecting rod (or pole or shank) 52 connected with the connecting board 51. The connecting board 51 has a center provided with a mounting hole 511. The connecting rod 52 is mounted in the mounting hole 511 of the connecting board 51. The magnet 30 is locked between the connecting board 51 and the connecting rod 52.

In the preferred embodiment of the present invention, the bottom of the housing 40 is provided with a through hole having a wall provided with an annular flange 41. The connecting board 51 has an outer face provided with a locking groove 512 locked onto the annular flange 41 of the housing 40, such that the connecting board 51 is mounted on the housing 40.

In the preferred embodiment of the present invention, the connecting board 51 has a bottom provided with a tapered guiding face 513 that has a guiding arrangement directed toward the locking groove 512 and guides the annular flange 41 of the housing 40 into the locking groove 512 of the connecting board 51.

In the preferred embodiment of the present invention, the magnet 30 has a trapezium (or trapezoid) arrangement. The connecting board 51 is provided with a first annular groove 516 and a second annular groove 514 connected to the first annular groove 516. The magnet 30 is mounted in the first annular groove 516 of the connecting board 51 and extends into the second annular groove 514 of the connecting board 51.

In the preferred embodiment of the present invention, the second annular groove 514 of the connecting board 51 has a wall provided with a plurality of protruding ribs pressing the magnet 30, such that the magnet 30 is locked steadily in the first annular groove and the second annular groove 514 of the connecting board 51.

In the preferred embodiment of the present invention, the mounting hole 511 of the connecting board 51 has a wall provided with an annular projection 515. The connecting rod 52 is provided with a retaining recess 521 mounted on the annular projection 515 of the connecting board 51, such that the connecting rod 52 is mounted on the connecting board 51.

In the preferred embodiment of the present invention, the connecting rod 52 is provided with a tapered guiding face that has a guiding arrangement directed toward the retaining recess 521 and guides the annular projection 515 of the connecting board 51 into the retaining recess 521 of the connecting rod 52.

In the preferred embodiment of the present invention, the connecting board 51 is made of silicone, such that the magnet 30 and the connecting rod 52 are inserted into the connecting board 51 easily.

In the preferred embodiment of the present invention, the lighting unit 10 has a horn structure with an opening directed toward the outside of the housing 40, to facilitate diffusion of the sound emitted from the sound device 20 in the housing 40.

In the preferred embodiment of the present invention, the flashlight and acoustics assembly further comprises a mounting seat 60, and an outer shell 70 mounted on the mounting seat 60. The housing 40 is mounted in the outer shell 70.

In the preferred embodiment of the present invention, the housing 40 is made of iron that is magnetically attracted with the magnet 30, such that the housing 40 is mounted in the outer shell 70 steadily.

Accordingly, the housing 40 is mounted in the outer shell 70 steadily by magnetism of the magnet 30, such that it is unnecessary for the user to hold the flashlight and acoustics assembly constantly by one hand, thereby greatly facilitating the user doing a work by two hands.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A flashlight and acoustics assembly comprising:
a housing;
a lighting unit mounted on an outside of the housing;
a sound device mounted in the housing;
a magnet mounted in the housing; and
a connecting unit mounted in the housing;
wherein:
the connecting unit includes a connecting board locked on a bottom of the housing, and a connecting rod connected with the connecting board;
the bottom of the housing is provided with a through hole having a wall provided with an annular flange;
the connecting board has an outer face provided with a locking groove locked onto the annular flange of the housing;
the connecting board is provided with a mounting hole;
the connecting rod is mounted in the mounting hole of the connecting board; and
the magnet is locked between the connecting board and the connecting rod.

2. The flashlight and acoustics assembly of claim 1, further comprising:
a mounting seat; and
an outer shell mounted on the mounting seat;
wherein the housing is mounted in the outer shell.

3. The flashlight and acoustics assembly of claim 1, wherein the connecting board has a bottom provided with a tapered guiding face that has a guiding arrangement directed toward the locking groove and guides the annular flange of the housing into the locking groove of the connecting board.

4. The flashlight and acoustics assembly of claim 1, wherein:
the magnet has a trapezium arrangement;
the connecting board is provided with a first annular groove and a second annular groove connected to the first annular groove; and
the magnet is mounted in the first annular groove of the connecting board and extends into the second annular groove of the connecting board.

5. The flashlight and acoustics assembly of claim 4, wherein the second annular groove of the connecting board has a wall provided with a plurality of protruding ribs pressing the magnet.

6. A flashlight and acoustics assembly comprising:
a housing;
a lighting unit mounted on an outside of the housing;
a sound device mounted in the housing;
a magnet mounted in the housing; and
a connecting unit mounted in the housing;
wherein:
the connecting unit includes a connecting board locked on a bottom of the housing, and a connecting rod connected with the connecting board;
the connecting board is provided with a mounting hole;
the connecting rod is mounted in the mounting hole of the connecting board;
the magnet is locked between the connecting board and the connecting rod;
wherein the mounting hole of the connecting board has a wall provided with an annular projection, and the connecting rod is provided with a retaining recess mounted on the annular projection of the connecting board.

7. The flashlight and acoustics assembly of claim 6, wherein the connecting rod is provided with a tapered guiding face that has a guiding arrangement directed toward the retaining recess and guides the annular projection of the connecting board into the retaining recess of the connecting rod.

8. A flashlight and acoustics assembly comprising:
a housing;
a lighting unit mounted on an outside of the housing;
a sound device mounted in the housing;
a magnet mounted in the housing; and
a connecting unit mounted in the housing;
wherein:
the connecting unit includes a connecting board locked on a bottom of the housing, and a connecting rod connected with the connecting board;
the connecting board is provided with a mounting hole;
the connecting rod is mounted in the mounting hole of the connecting board;
the magnet is locked between the connecting board and the connecting rod; and
the connecting board is made of silicone.

9. The flashlight and acoustics assembly of claim 1, wherein the lighting unit has a horn structure with an opening directed toward the outside of the housing.

* * * * *